US009747873B2

(12) United States Patent
Lee

(10) Patent No.: US 9,747,873 B2
(45) Date of Patent: Aug. 29, 2017

(54) TONE CONTROL MEMBER AND TONE-CONTROLLED FUNCTIONAL ACOUSTIC GUITAR

(71) Applicant: GOPHER WOOD CO.,LTD., Yangju-si, Gyeonggi-do (KR)

(72) Inventor: Kyu Hun Lee, Seoul (KR)

(73) Assignee: GOPHER WOOD CO., LTD., Yangju-si, Gyeonggi-do (KR)

( * ) Notice: Subject to any disclaimer, the term of this patent is extended or adjusted under 35 U.S.C. 154(b) by 0 days.

(21) Appl. No.: 15/103,636

(22) PCT Filed: Nov. 25, 2014

(86) PCT No.: PCT/KR2014/011351
§ 371 (c)(1),
(2) Date: Jun. 10, 2016

(87) PCT Pub. No.: WO2015/093741
PCT Pub. Date: Jun. 25, 2015

(65) Prior Publication Data

US 2016/0314767 A1 Oct. 27, 2016

(30) Foreign Application Priority Data

Dec. 19, 2013 (KR) ..... 10-2013-0159444
Jan. 6, 2014 (KR) ..... 10-2014-0001154
Jul. 15, 2014 (KR) ..... 10-2014-0088809

(51) Int. Cl.
*G10D 1/08* (2006.01)
*G10D 3/00* (2006.01)
*G10D 3/02* (2006.01)

(52) U.S. Cl.
CPC ..... *G10D 1/08* (2013.01); *G10D 3/00* (2013.01); *G10D 3/02* (2013.01)

(58) Field of Classification Search
CPC ..... G10D 3/00; G10D 3/02; G10D 3/04
See application file for complete search history.

(56) References Cited

U.S. PATENT DOCUMENTS 5,325,756 A * 7/1994 Sugden ..... G10D 3/02 84/276
2012/0090449 A1 4/2012 Lee
2013/0139669 A1* 6/2013 Siwko ..... G10D 3/00 84/277

FOREIGN PATENT DOCUMENTS

CN 201051375 Y 4/2008
JP 3185007 U9 7/2013
(Continued)

*Primary Examiner* — Kimberly Lockett
(74) *Attorney, Agent, or Firm* — Novick, Kim & Lee, PLLC; Jae Youn Kim

(57) ABSTRACT

The present invention relates to a tone-controlled functional acoustic guitar that prevents a body from being deformed to avoid the changes in sound, increases sound transmission, finely adjusts tone fields in accordance with a player or user's selection, and has a specific structure on a head thereof to suppress bending on a neck caused by the tension of strings. According to the present invention, the tone-controlled functional acoustic guitar includes: a body having a top plate, a bottom plate and a side plate connecting the top plate and the bottom plate with each other; a neck fixed to one side of the body; a head disposed at the end portion of the neck; and a tone control member detachably mounted at the inside of the body in such a manner as to be controlled in length to support a space between the top plate and the bottom plate of the body, wherein the tone control member includes: a contacting and moving member; and height control means expandably and contractably moving the contacting and moving member.

16 Claims, 9 Drawing Sheets

(56) References Cited

FOREIGN PATENT DOCUMENTS

| | | | |
|---|---|---|---|
| KR | 10-2001-0097591 | A | 11/2001 |
| KR | 10-2010-0120629 | A | 11/2010 |
| KR | 10-1245381 | B1 | 3/2013 |

* cited by examiner

[Fig. 1]
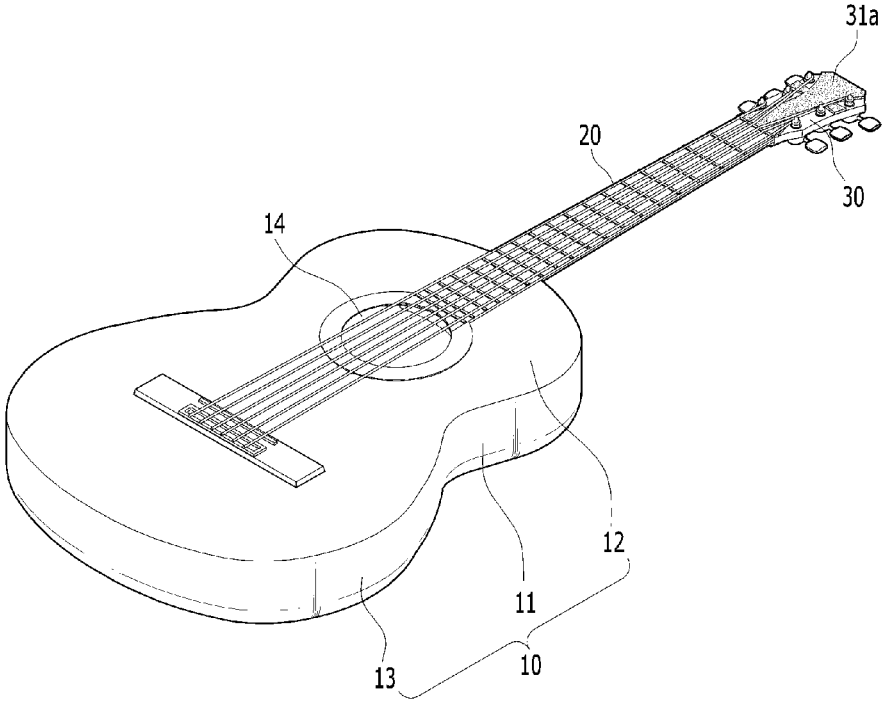
[Fig. 2]
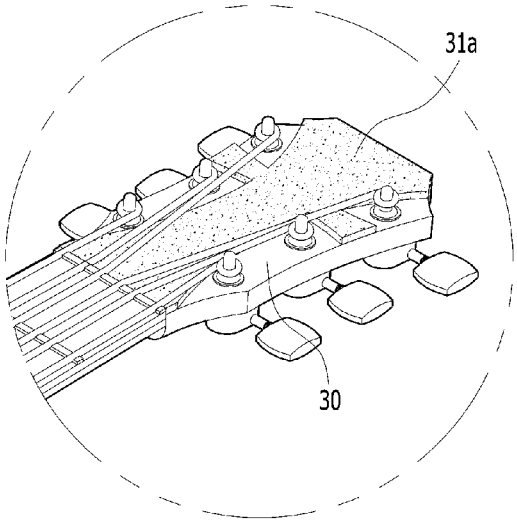

[Fig. 3]
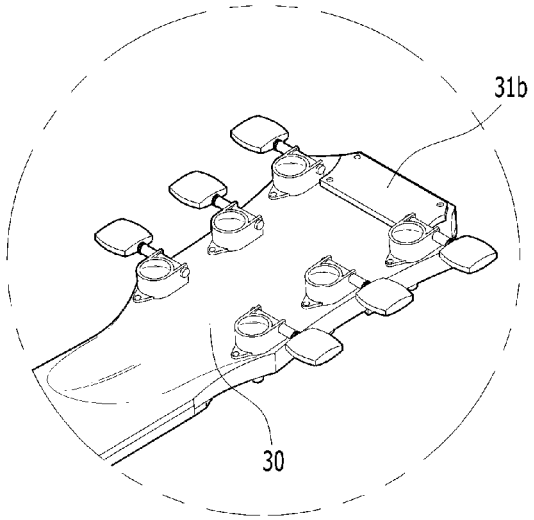
[Fig. 4]
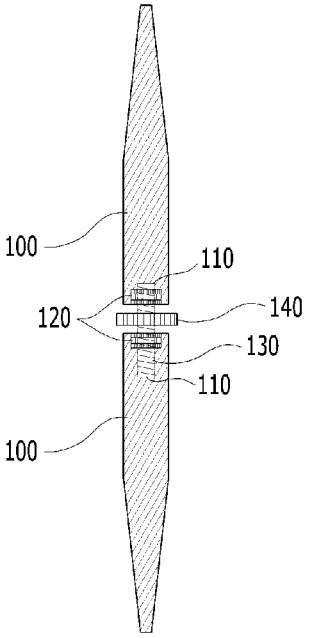

[Fig. 5]
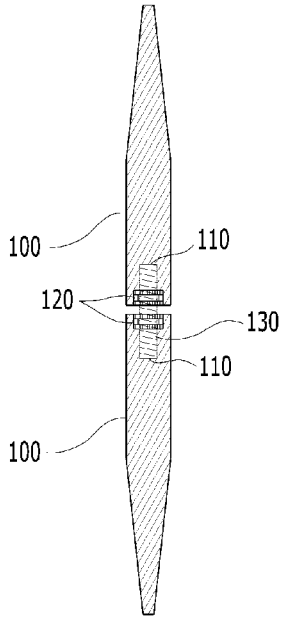
[Fig. 6]
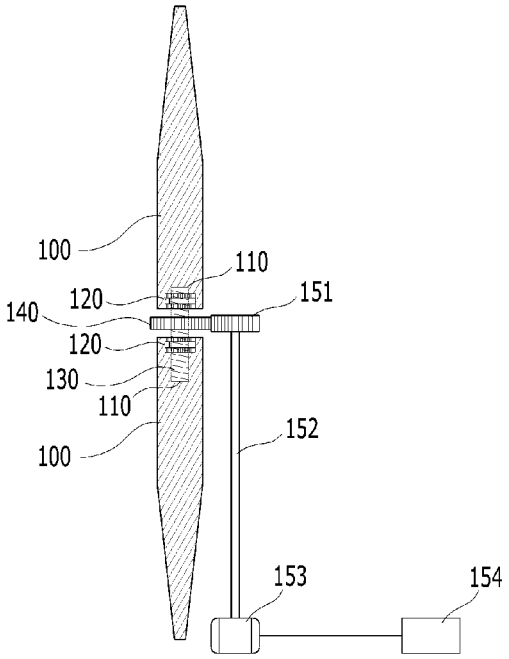

[Fig. 7]
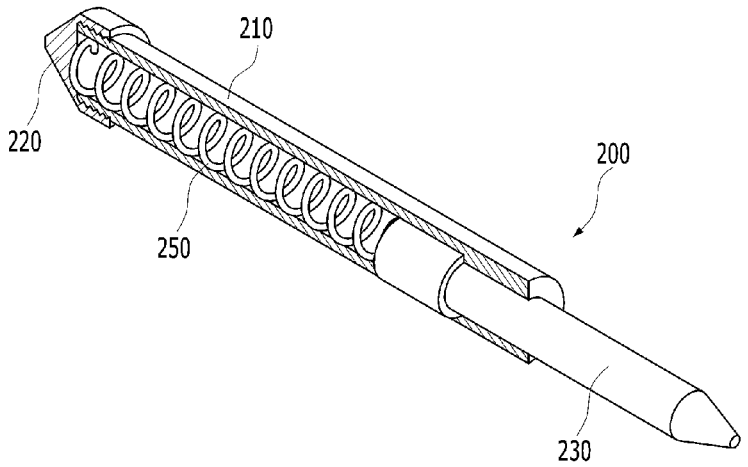

[Fig. 8]
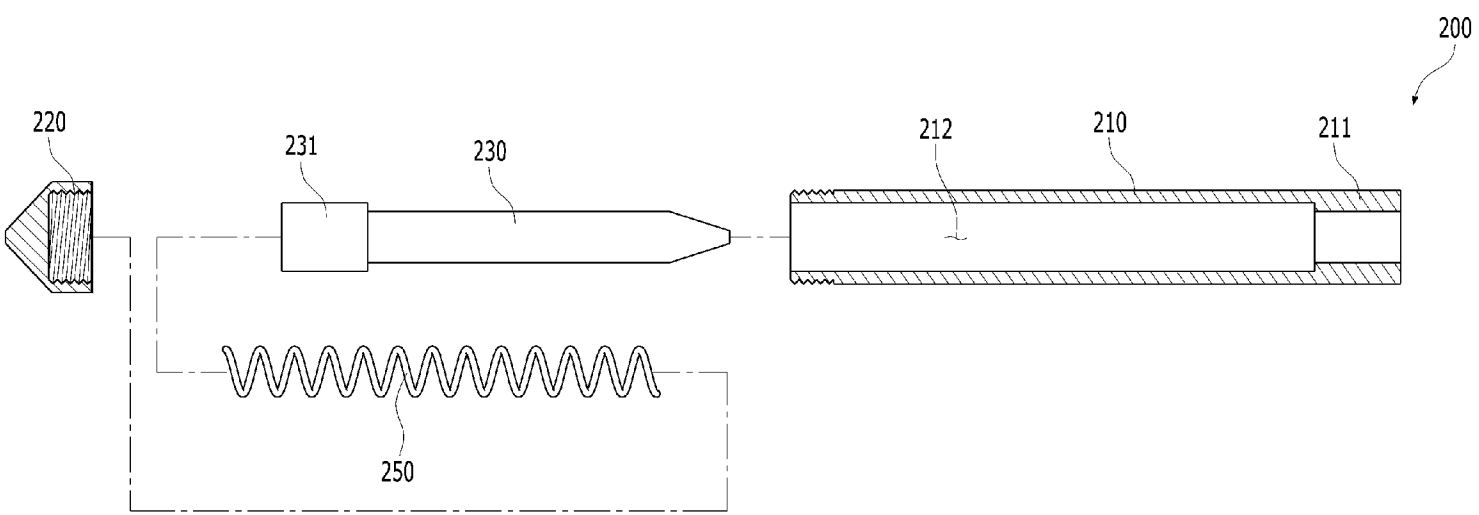

[Fig. 9]
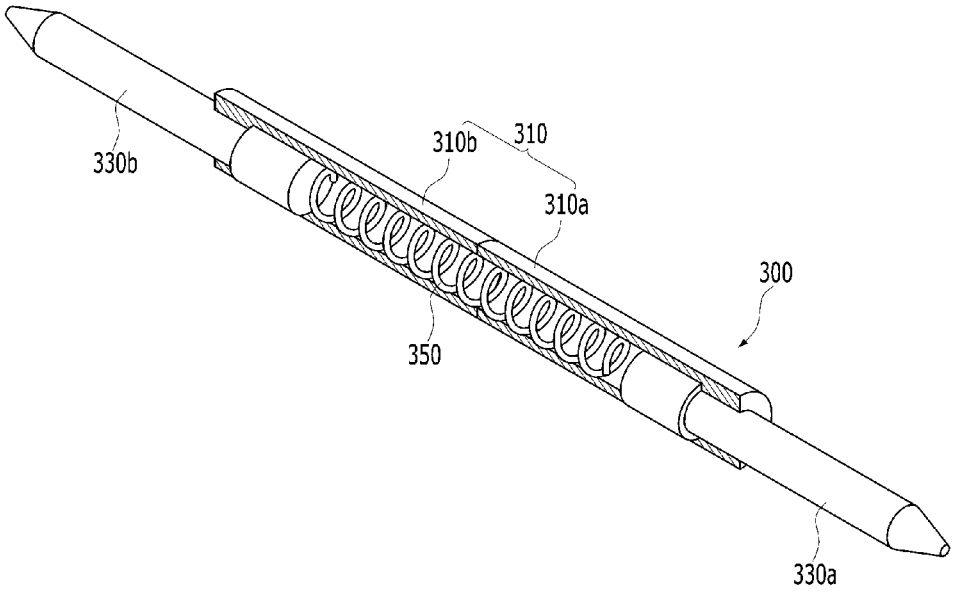

[Fig. 10]
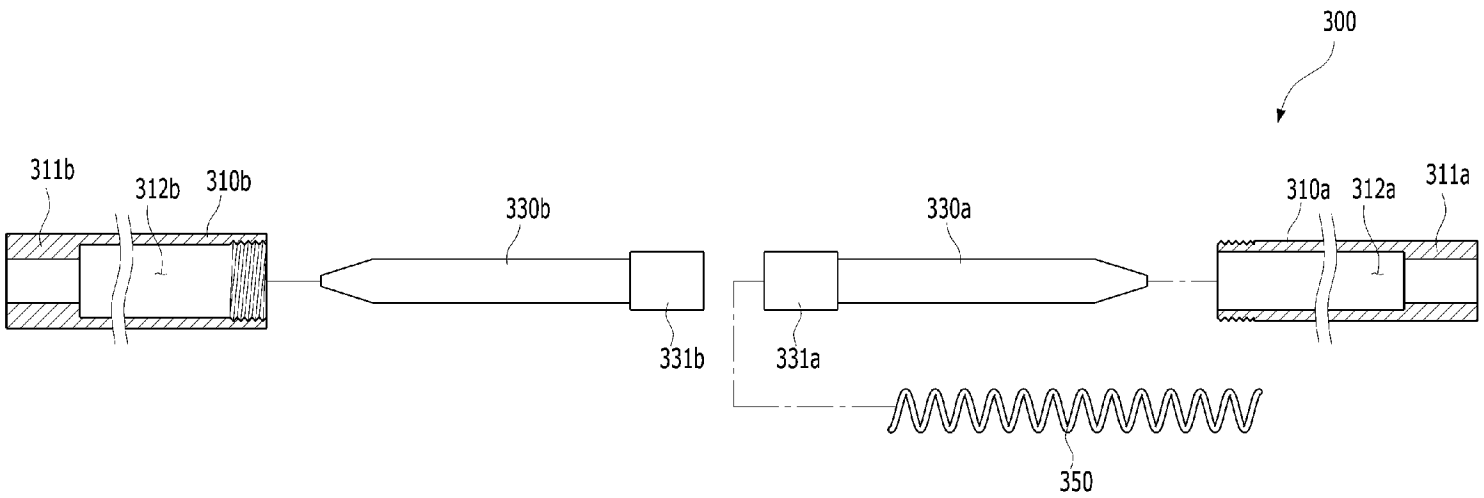

[Fig. 11]
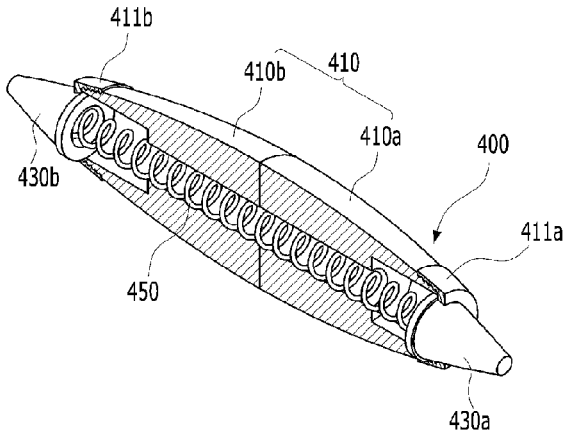
[Fig. 12]
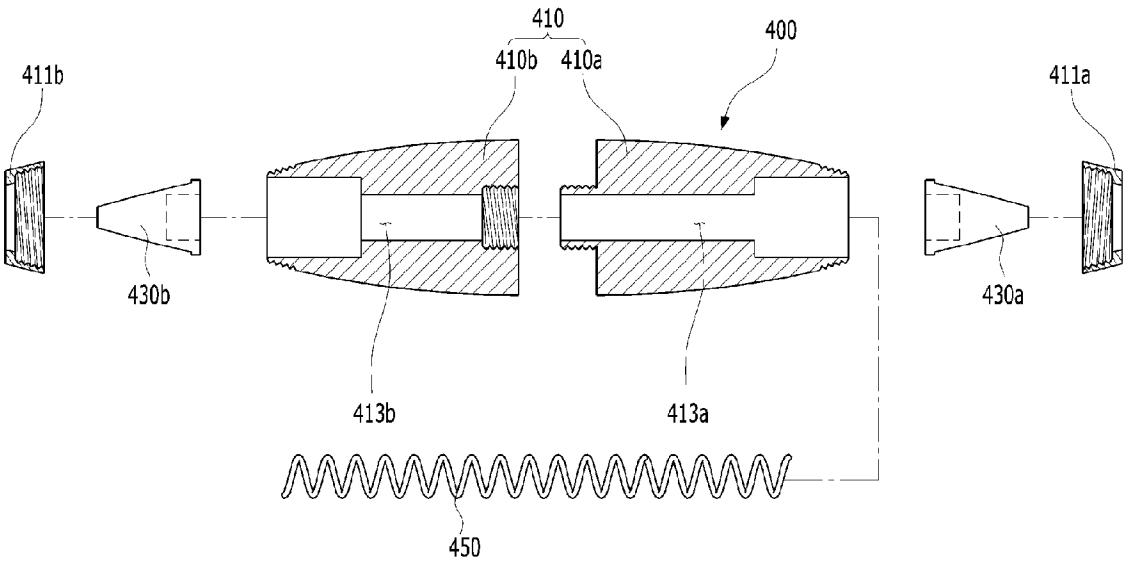

[Fig. 13]
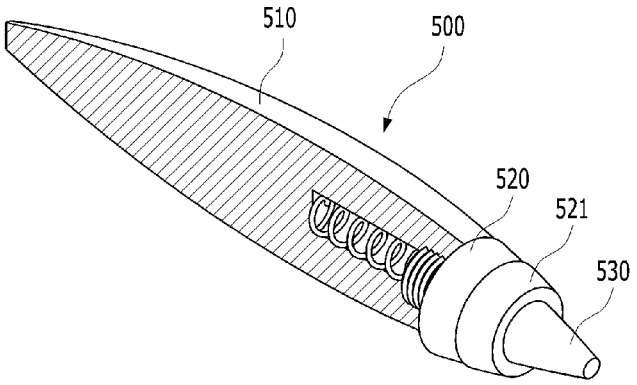
[Fig. 14]
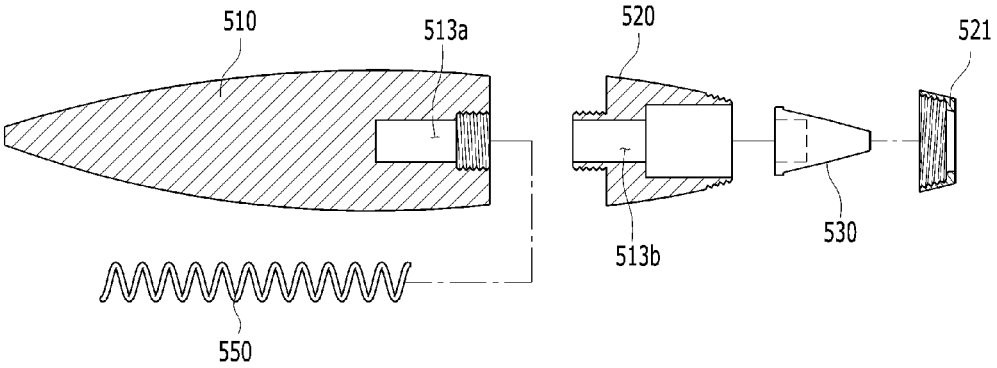
[Fig. 15]
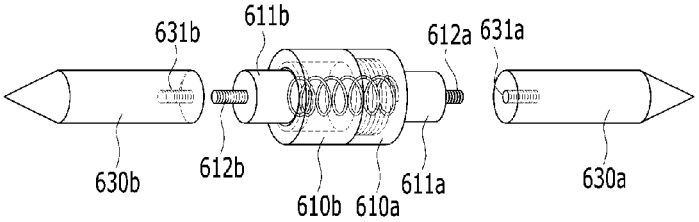
[Fig. 16]
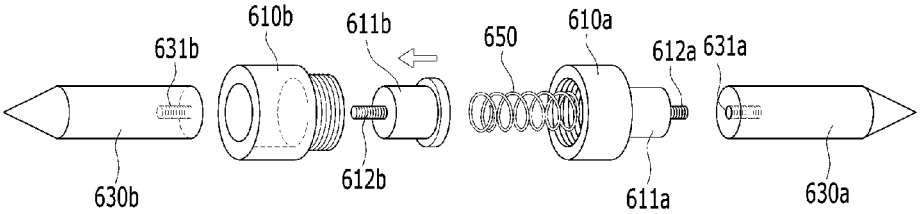

TONE CONTROL MEMBER AND TONE-CONTROLLED FUNCTIONAL ACOUSTIC GUITAR

TECHNICAL FIELD

The present invention relates to a tone-controlled functional acoustic guitar, and more particularly, to a tone-controlled functional acoustic guitar that prevents a body from being deformed to avoid the changes in sound, increases sound transmission, finely adjusts tone fields in accordance with a player or users selection, and has a specific structure on a head thereof to suppress bending on a neck caused by the tension of strings.

BACKGROUND ART

Generally, a violin, a cello, a guitar and the like are kinds of string instruments which produce sound by vibrating or plucking strings, and the string instruments are applicable to more various music genres when compared with other instruments.

For instance, the guitar is classified into acoustic guitar, base guitar, classic guitar, electric guitar and so on.

The guitar is made through a large number of production processes, and recently, mechanical machining processes have been increasingly applied to the manufacturing process of the guitar.

In the conventional guitar, however, the body of the guitar may be deformed due to the tension of the strings and the air flow in the sound resonance while is being played, and further, a top plate and a bottom plate of the body of the guitar may be deformed due to the surrounding environment (for example, humidity), which undesirably results in the changes in the original sound produced from the guitar.

DISCLOSURE OF INVENTION

Technical Problem

Accordingly, the present invention has been made to solve the above-mentioned problems, and it is an object of the present invention to provide a tone-controlled functional acoustic guitar that prevents a body from being deformed to avoid the changes in sound and at the same time finely adjusts tone fields in accordance with a player's selection to allow sound to be stretched out or abundantly vibrated.

It is another object of the present invention to provide a tone-controlled functional acoustic guitar that adjusts tone automatically or manually in accordance with a player's selection and preference.

It is yet another object of the present invention to provide a tone-controlled functional acoustic guitar that suppresses bending on a neck caused by the tension of strings.

Solution to Problem

To accomplish the above-mentioned objects, according to the present invention, there is provided a tone-controlled functional acoustic guitar including: a body having a top plate, a bottom plate and a side plate connecting the top plate and the bottom plate with each other; a neck fixed to one side of the body; a head disposed at the end portion of the neck; and a tone control member detachably mounted at the inside of the body in such a manner as to be controlled in length to support a space between the top plate and the bottom plate of the body.

According to the present invention, preferably, the tone control member includes: a contacting and moving member; and height control means expandably and contractably moving the contacting and moving member.

According to the present invention, preferably, the contacting and moving member is formed of a contact member segmented symmetrically into two parts and has a sectional shape of a cone, a conical frustum, a cylinder or the like.

According to the present invention, preferably, the contacting and moving member is formed of a contact member segmented symmetrically into two parts and has a sectional shape of a cone having the tip rounded.

According to the present invention, preferably, the height control means has a screw moving way so that the contact member segmented symmetrically into two parts is expanded and contracted.

According to the present invention, preferably, the height control means includes: coupling holes formed on the end portions of the two segmented parts of the contact member facing each other; nuts mounted in the coupling holes; a moving screw screw-coupled to the nuts; and an adjusting knob fixed to the moving screw.

According to the present invention, preferably, the tone control member includes: a resonance body having a given internal space formed therein; a resonance transmitter whose a portion is inserted into the resonance body; and a position adjuster inserted into the resonance body to move the resonance transmitter in a longitudinal direction of the resonance body.

According to the present invention, preferably, one end of the resonance body is formed to allow the resonance transmitter to move in the longitudinal direction of the resonance body by means of the position adjuster disposed in the internal space of the resonance body, and the other end of the resonance body is fixedly formed to allow the resonance transmitter to move in the longitudinal direction of the resonance body by means of the position adjuster.

According to the present invention, preferably, the other end of the resonance body is fixedly fastened to a resonance support supporting the position adjuster to transmit balanced sound to the top plate and the bottom plate of the guitar.

According to the present invention, preferably, the position adjuster moves the resonance transmitter in a horizontal direction by using elasticity thereof.

According to the present invention, preferably, the resonance body or the resonance transmitter is made of any one selected from timbers, plastic, bone materials, tusk, iron, a urethane and an acetal to balancedly distribute the sound resonated through strings to the top plate and the bottom plate of the guitar.

According to the present invention, preferably, the resonance transmitter or the resonance support is formed of a conical shape, and the tip of the cone is rounded.

According to the present invention, preferably, the tone control member is located around a sound hole formed on the top plate, from which the resonance of the sound is produced, to maintain the tone balance between high frets and low frets.

According to the present invention, preferably, the head has a weight adding member mounted on the front or back surface thereof to add a given weight thereto.

According to the present invention, preferably, the weight adding member is made of a metal plate having the corresponding shape to the head, and the metal plate has a logo or emblem provided thereon.

Advantageous Effects of Invention

According to the present invention, the tone-controlled functional acoustic guitar prevents the body from being deformed to avoid the changes in sound and at the same time finely adjusts the tone fields of the body in accordance with a player's selection, thus providing the tone in accordance with the player's preference and expanding the range of the selection for purchase.

Further, the tone-controlled functional acoustic guitar adds the weight to the head to suppress bending on the neck caused by the tension of the strings and extends the keeping force of the sound to improve the sound balance between high frets and low frets.

BRIEF DESCRIPTION OF DRAWINGS

FIG. 1 is a perspective view showing a tone-controlled functional acoustic guitar according to the present invention.

FIG. 2 is a perspective showing a weight adding member mounted on the front surface of a head of the tone-controlled functional acoustic guitar according to the present invention.

FIG. 3 is a perspective showing a weight adding member mounted on the back surface of a head of the tone-controlled functional acoustic guitar according to the present invention.

FIGS. 4 and 5 are sectional views showing a first example of a tone control member in the tone-controlled functional acoustic guitar according to the present invention.

FIG. 6 is a sectional view showing automatic adjusting means controlling the tone control member according to the present invention.

FIG. 7 is a perspective view showing a second example of the tone control member in the tone-controlled functional acoustic guitar according to the present invention.

FIG. 8 is an exploded view showing the tone control member of FIG. 7.

FIG. 9 is a perspective view showing a third example of the tone control member in the tone-controlled functional acoustic guitar according to the present invention.

FIG. 10 is an exploded view showing the tone control member of FIG. 9.

FIG. 11 is a perspective view showing a fourth example of the tone control member in the tone-controlled functional acoustic guitar according to the present invention.

FIG. 12 is an exploded view showing the tone control member of FIG. 11.

FIG. 13 is a perspective view showing a fifth example of the tone control member in the tone-controlled functional acoustic guitar according to the present invention.

FIG. 14 is an exploded view showing the tone control member of FIG. 13.

FIG. 15 is a perspective view showing a sixth example of the tone control member in the tone-controlled functional acoustic guitar according to the present invention.

FIG. 16 is an exploded view showing the tone control member of FIG. 15.

MODE FOR THE INVENTION

Objects, characteristics and advantages of the present invention will be more clearly understood from the detailed description as will be described below and the attached drawings.

Before the present invention is disclosed and described, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill n the art to variously employ the present invention in virtually any appropriately detailed structure.

The term 'coupled' or 'connected', as used herein, is defined as connected, although not necessarily directly, and not necessarily mechanically. To the contrarily, the term 'directly coupled' or 'directly connected', as used herein, is defined as connected without having any component disposed therebetween.

The terminology used herein is for the purpose of describing particular embodiments only and is not intended to be limiting. The term 'a' or 'an', as used herein, are defining as one or more than one. The term 'including' and/or 'having', as used herein are intended to refer to the above features, numbers, steps, operations, elements, parts or combinations, and it is to be understood that the terms are not intended to preclude the presence of one or more features, numbers, steps, operations, elements, parts or combinations and added possibilities.

The term 'parts', 'units', and 'module', as used herein, are intended to refer to the unit processing at least one function or operation.

The present invention is disclosed with reference to the attached drawings wherein the corresponding parts in the embodiments of the present invention are indicated by corresponding reference numerals and the repeated explanation on the corresponding parts will be avoided. If it is determined that the detailed explanation on the well known technology related to the present invention makes the scope of the present invention not clear, the explanation will be avoided for the brevity of the description.

Hereinafter, an explanation on a tone-controlled functional acoustic guitar according to the present invention will be in detail given with reference to the attached drawing.

As shown in FIG. 1, a tone-controlled functional acoustic guitar according to the present invention largely includes a body 10, a neck 20, a head 30 and a tone control member.

The body 10 has a top plate 12, a bottom plate 13 and a side plate 11 connecting the top plate 12 and the bottom plate 13 with each other. That is, the body 10 has the peanut-like side plate 11, the top plate 12 attached to the top periphery of the side plate 11, and the bottom plate 13 attached to the underside periphery of the side plate 11, thus producing resonant sound through strings.

Desirably, the edge along which the side plate 11 and the top plate 12 of the body 10 are connected is rounded, which allows the body 10 to be easily surrounded with a player (especially, a beginner)'s body, so that the player can play the guitar very comfortably.

Further, the body 10 is made of soft wood having straight grain such as *Picea abies, Juniperus occidentalis, Cryptomeria japonica* and the like.

The neck 20 is fixed to one side of the body 10 to arrange the strings thereon, so that the player holds chords according to scales.

The head 30 is bonded to the end portion of the neck 20 to adjust sound heights of the strings.

According to the present invention, the neck 20 and the head 30 are made of general materials and also have typical shapes, and accordingly, an explanation on them will be avoided for the brevity of the description.

The tone control member (not shown) is disposed on a space between the top plate 12 and the bottom plate 13 to support the space between the top plate 12 and the bottom plate 13 thereagainst. Of course, one or more tone control members may be disposed, and the tone control member will be in detail described later.

As shown in FIGS. 2 and 3, the tone-controlled functional acoustic guitar according to the present invention includes the body 10, the neck 20, the head 30 and the tone control member, wherein a weight adding member 31*a* is mounted on the head 30.

So as to add a given weight to the head 30, the weight adding member 31*a* is mounted on the head 30 adjusting the lengths of the strings.

The weight adding member 31*a* is made of a metal plate having the corresponding shape to the head 30, and desirably, a logo or emblem is provided on the metal plate.

Like this, the weight adding member 31*a*, which is made of the metal plate, applies the given weight to the head 30, thus preventing the neck 20 from being bent due to the tension of the strings. That is, the formation of the weight adding member 31*a* allows the given weight to be applied to the head 30, thus preventing the deformation of the neck 20 caused by the strings.

Further, mounting the weight adding member 31*a* on the head 30 enables sound to be kept longer and allows the sound balance between high positions and low positions to be improved.

Furthermore, the logo or emblem is attached to the weight adding member 31*a* made of the metal plate having the corresponding shape to the head 30, thus upgrading the outer appearance thereof and providing the advertising effects for guitar manufacturers.

On the other hand, the weight adding member 31*a* may be detachably mounted on the head 30. That is, the weight adding member 31*a* is detachably mounted on the head 30, which allows the weight adding member 31*a* to be mounted on the head of the existing acoustic guitar. Accordingly, the weight adding member 31*a* may have various shapes capable of being mounted on the heads of various kinds of conventional acoustic guitars.

While the weight adding member 31*a* is being mounted on the head 30, desirably, it is not brought into contact with the strings wound on string winders mounted on the head 30.

Further, the weight adding member 31*a* mounted on the head 30 becomes increased in thickness as it goes from the neck 20. That is, the thickness of the weight adding member 31*a* mounted on the other side of the head 30 is higher than that mounted on one side of the head 30 connected to the end portion of the neck 20. As the thickness of the weight adding member 31*a* is varied, relatively heavy weight is applied to the head 30 from the weight adding member 31*a*, which prevents the neck 20 from being bent due to the tension of the stings.

As shown in FIG. 3, the weight adding member 31*a* may be mounted on the back surface of the head 30 as well as the front surface of the head 30. Even if the weight adding member 31*a* is mounted on the back surface of the head 30, it has the same functions as that mounted on the front surface of the head 30, and accordingly, an explanation on the weight adding member 31*a* mounted on the back surface of the head 30 will be avoided for the brevity of the description.

As shown in FIGS. 4 and 5, the tone control member according to the present invention includes a contacting and moving member 100 and height control means expandably and contractably moving the contacting and moving member 100.

The contacting and moving member 100 is formed of a contact member segmented into two parts and has a sectional shape of a cone, a conical frustum, a cylinder and the like.

In this case, if the contacting and moving member 100 has a conical shape, it is desirably rounded on the tips (that is, the ends coming into contact with the top plate and the bottom plate of the guitar) thereof.

Only if the contacting and moving member 100 can move expandably and contractably through the height control means, the height control means may have any structure.

For example, the height control means is configured in a screw moving way to allow the contacting and moving member 100 to move expandably and contractably.

In more detail, the height control means includes coupling holes 110 formed on the end portions of the two segmented parts of the contact member facing each other, nuts 120 mounted in the coupling holes 110, a moving screw 130 screw-coupled to the nuts 120, and an adjusting knob 140 fixed to the moving screw 130.

In the state where the contacting and moving member 100 is disposed at the inside of the guitar, the adjusting knob 140 of the height control means rotates to cause the moving screw 130 screw-coupled to the nuts 120 to rotate, so that the contacting and moving member 100 moves expandably and contractably. As the contacting and moving member 100 moves, the space between the top plate 12 and the bottom plate 13 of the body 10 can be extended or reduced.

On the other hand, the tone control member according to the present invention further includes automatic adjusting means automatically driving the height adjusting means. That is, the height adjusting means conducts manually operating control through the adjusting knob 140, but the automatic adjusting means conducts automatically operating control through gear teeth replacing the adjusting knob 140, a forwardly and backwardly rotating motor having a driving shaft rotating the gear teeth, and an operating switch rotating the motor forwardly and backwardly and turning the motor off.

As shown in FIG. 6, the automatic adjusting means includes a rotating unit rotating the adjusting knob 140 and an operating unit operating the rotating unit and drawn outward from the guitar.

In more detail, the rotating unit includes a driving gear 151 engaged with the adjusting knob 140, a driving motor 153 mounted on the inside of the guitar in such a manner as to be forwardly and backwardly driven and having a rotary shaft 152 coupled to the driving gear 151, a battery unit (not shown) applying power to the driving motor 153, and an operating switch 154 connected to the driving motor 153 and mounted on the external surface of the guitar.

In this case, the adjusting knob 140 is formed of gear teeth.

The driving motor 153, which is accommodated into a housing (not shown), is detachably fixed to the inside of the guitar. The battery unit is formed integrally to the housing into which the driving motor 153 is accommodated.

The operating switch 153 is disposed on the external surface of the guitar for a player's easy manipulation, but it may be disposed at the inner space of the guitar after the height adjustment. Otherwise, the operating switch 153 may be detachably fixed to a sound hole 14 (See FIGS. 1 and 2) by means of a clamp type fixing member.

Accordingly, the contacting and moving member 100 of the tone control member can be automatically expanded and contracted through the automatic adjusting means, thus achieving easy adjustment.

Since the guitar is generally made of wood, the tone control member according to the present invention supports the guitar thereagainst to prevent the deformation of the body, especially, the deformation in the space between the top plate and the bottom plate of the guitar and to allow the sound produced from the sound hole to be varied through the expansion and contraction.

That is, if the contacting and moving member 100 is expandably adjusted, sound becomes more stretched out and hard, which is adequate to finger style, and contrarily, if the contacting and moving member 100 is contractibly adjusted, sound becomes more abundant.

As shown in FIGS. 7 and 8, the tone control member 200 according to a second example of the present invention includes a resonance body 210, a resonance transmitter 230, and a position adjuster 250.

The resonance body 210 has a given internal space 212 formed at the inside thereof. The position adjuster 250 is inserted into the internal space 212.

Further, one end of the resonance body 210 is open to allow the resonance transmitter 230 to move from one end of the resonance body 210 in a longitudinal direction of the resonance body 210. At this time, the resonance body 210 has a deviation prevention portion 211 formed on one end thereof to prevent the resonance transmitter 230 moving in the longitudinal direction thereof from being arbitrarily deviated therefrom.

The diameter of the deviation prevention portion 211 is desirably smaller than that of the internal space 212.

On the other hand, the other end of the resonance body 210 is open in such a manner as to be fastened to a resonance support 220 supporting the position adjuster 250. In this case, the other end of the resonance body 210 has a shape of a protruding screw fastened to the resonance support 220, and the resonance support 220 has a shape of a concave screw fastened to the other end of the resonance body 210. Of course, the resonance support 220 may protrude, and the other end of the resonance body 210 may be concave.

That is, only if the other end of the resonance body 210 and the resonance support 220 are fastened to each other to rigidly support the position adjuster 250, their shapes do not matter.

The resonance support 220 has a conical shape. If the resonance support 220 has a conical shape, the tip of the resonance support 220 is desirably sharp, rounded, or a circularly angled to ensure maximum resonance, thus transmitting balanced sound to the space between the top plate 12 and the bottom plate 13 of the guitar.

The shape of the tip of the resonance support 220 is not limited thereto and may be varied in accordance with the characteristics of sound.

The resonance transmitter 230 has a shape of a cone, a conical frustum, or a cylinder and is brought into contact with the top plate 12 or the bottom plate 13 of the guitar. If the resonance transmitter 230 has a shape of a cone or conical frustum, one end of the resonance transmitter 230 has a tip. The tip of the resonance transmitter 230 is desirably sharp, dull rounded, or a circularly angled to ensure maximum resonance, thus transmitting balanced sound to the space between the top plate 12 and the bottom plate 13 of the guitar. The shape of the tip of the resonance transmitter 230 is not limited thereto and may be varied in accordance with the characteristics of sound.

In this case, the tip of the resonance transmitter 230 and the tip of the resonance support 220 have the same shape as each other, and otherwise, they may have the different shapes from each other in accordance with the top plate 12 and the bottom plate 13 of the guitar.

Further, the resonance transmitter 230 has a deviation prevention step 231 formed on the other end thereof in such a manner as to be disposed in the internal space 212 of the resonance body 210 to prevent the arbitrary deviation from the resonance body 210.

The diameter of the deviation prevention step 231 is desirably larger than that of the resonance transmitter 230. More desirably, the diameter of the deviation prevention step 231 is smaller than that of the internal space 212 of the resonance body 210 and larger than that of the deviation prevention portion 211.

Further, the diameter of the resonance transmitter 230 is smaller than that of the deviation prevention portion 211, so that the resonance transmitter 230 can be easily operated in the longitudinal direction from one end of the resonance body 210.

The resonance body 210 or the resonance transmitter 230 as mentioned above is made of various materials such as all kinds of timbers, plastic, bone materials, tusk, iron and the like. According to the present invention, the resonance body 210 or the resonance transmitter 230 is desirably made of a urethane.

That is, the urethane has particles capable of easily transmitting sound, thus evenly distributing the sound resonated through the strings to the top plate 12 and the bottom plate 13 of the guitar.

Besides, the urethane has given elasticity, so that the top plate 12 and the bottom plate 13 of the guitar can be more rigidly pushed by means of the elasticity of the urethane and the position adjuster 250 as will be discussed later.

Further, the resonance body 210 or the resonance transmitter 230 is desirably made of an acetal. The acetal is a polymer having high crystalline, thus exhibiting high mechanical strength and excellent abrasion resistance. Accordingly, the acetal is hard and not changed in shape even if a strong pressure is applied thereto, so that the top plate 12 and the bottom plate 13 of the guitar can be more rigidly pushed by means of the characteristics of the acetal.

Like this, the resonance body 210 or the resonance transmitter 230 is made of a urethane or acetal, thus improving the balance of sound, the prevention of the contraction of the top plate 12 and the bottom plate 13 of the guitar, and the tone changes in the sound.

The position adjuster 250 is inserted into the internal space 212 of the resonance body 210 to move the resonance transmitter 230 in the longitudinal direction of the resonance body 210. The position adjuster 250 has an elastic material, so that the resonance transmitter 230 moves in the longitudinal direction of the resonance body 210 through the elasticity of the position adjuster 250.

At this time, the position adjuster 250 is formed of a spring. Only if the position adjuster 250 has elasticity to move the resonance transmitter 230 from the resonance body 210, it may have any shape or material.

Like this, the space between the top plate 12 and the bottom plate 13 of the guitar is pushed supportedly by means of the elasticity of the position adjuster 250, thus in advance preventing the top plate 12 and the bottom plate 13 of the guitar from being deformed due to climate and easily transmitting the resonance of sound between the top plate 12 and the bottom plate 13 of the guitar.

At this time, the tone control member 200 according to the present invention is desirably located around the sound hole 14 from which the rear portion of high frets, that is, the resonance of sound is emitted. In this case, the sound hole 14 is formed on the center of the top plate 12 on the body 10. Accordingly, the formation of the tone control member 200 allows the tone between high frets and low frets to be easily balanced.

As shown in FIGS. 9 and 10, a tone control member 300 according to a third example of the present invention includes a resonance body 310, a resonance transmitter 330, and a position adjuster 350.

The functions of the parts of the tone control member 300 and the organic relations between the functions are the same as those in the tone control member 200 according to the second example of the present invention, and accordingly, an explanation on them will be avoided for the brevity of the description.

The resonance body 310 has given internal spaces 312*a* and 312*b* formed at the inside thereof. The position adjuster 350 is inserted into the internal spaces 312*a* and 312*b*.

Further, both ends of the resonance body 310 are open to allow a first resonance transmitter 330*a* of the resonance transmitter 330 to move from one end of the resonance body 310 in the longitudinal direction of the resonance body 310 and a second resonance transmitter 330*b* of the resonance transmitter 330 moves from the other end of the resonance body 310 in the longitudinal direction of the resonance body 310. At this time, the resonance body 310 has a first deviation prevention portion 311*a* formed on one end thereof to prevent the first resonance transmitter 330*a* moving in the longitudinal direction thereof from being arbitrarily deviated therefrom and a second deviation prevention portion 311*b* formed on the other end thereof to prevent the second resonance transmitter 330*b* moving in the longitudinal direction thereof from being arbitrarily deviated therefrom.

At this time, the diameters of the first deviation prevention portion 311*a* and the second deviation prevention portion 311*b* are desirably smaller than those of the internal spaces 312*a* and 312*b*, and the diameters of the first deviation prevention portion 311*a* and the second deviation prevention portion 311*b* are the same as each other.

Further, the resonance body 310 includes a first resonance body 310*a* on which a portion of the first deviation prevention portion 311*a* operates and a second resonance body 310*b* on which a portion of the second deviation prevention portion 311*b* operates.

In this case, the other end of the first resonance body 310*a* has a shape of a protruding screw fastened to one end of the second resonance body 310*b*, and one end of the second resonance body 310*b* has a shape of a concave screw fastened to the other end of the first resonance body 310*a*. Of course, one end of the second resonance body 310*b* may protrude, and the other end of the first resonance body 310*a* may be concave.

That is, only if the other end of the first resonance body 310*a* and one end of the second resonance body 310*b* are fastened to each other to insert the position adjuster 350 thereinto and to move the resonance transmitter 330, their shapes do not matter.

The resonance transmitter 330 includes the first resonance transmitter 330*a* and the second resonance transmitter 330*b*. The first resonance transmitter 330*a* and the second resonance transmitter 330*b* have the same configurations and functions as the resonance transmitter 230 according to the second example of the present invention, and accordingly, an explanation on them will be avoided for the brevity of the description.

Further, the first resonance transmitter 330*a* has a first deviation prevention step 331*a* formed on the other end thereof in such a manner as to be disposed in the internal spaces 312*a* and 312*b* of the first resonance body 310*a* to prevent the arbitrary deviation from the first resonance body 310*a*, and the second resonance transmitter 330*b* has a second deviation prevention step 331*b* formed on one end thereof in such a manner as to be disposed in the internal spaces 312*a* and 312*b* of the second resonance body 310*b* to prevent the arbitrary deviation from the second resonance body 310*b*.

The diameter of the first deviation prevention step 331*a* is desirably larger than that of the first resonance transmitter 330*a*. More desirably, the diameter of the first deviation prevention step 331*a* is smaller than those of the internal spaces 312*a* and 321*b* of the first resonance body 310*a* and larger than that of the first deviation prevention portion 311*a*.

Of course, the diameter of the first resonance transmitter 330*a* is smaller than that of the first deviation prevention portion 311*a*, so that the first resonance transmitter 330*a* can be easily operated from one end of the first resonance body 310*a* in the longitudinal direction. In this case, the diameter of the second deviation prevention step 331*b* is the same as of the first deviation prevention step 331*a*, and accordingly, the operations of the second deviation prevention step 331*b* will be understood from those of the first deviation prevention step 331*a*.

Further, one position adjuster 350 is provided, but it is not limited thereto. That is, the position adjuster 350 may be divided into a first position adjuster (not shown) and a second position adjuster (not shown), so that the first position adjuster is inserted into the internal space 312*a* of the first resonance body 310*a* and the second position adjuster is inserted into the internal space 312*b* of the second resonance body 310*b*.

The tone control member 300 according to the third example of the present invention is symmetrically formed in left and right sides, thus transmitting the resonance of sound from the top plate 12 and the bottom plate 13 of the guitar to be balanced and easily maintaining the balance between high frets and low frets.

As shown in FIGS. 11 and 12, a tone control member 400 according to a third example of the present invention includes a resonance body 410, a resonance transmitter 430, and a position adjuster 450.

The functions of the parts of the tone control member 400 and the organic relations between the functions are the same as those in the tone control members 200 and 300 according to the second and third examples of the present invention, and accordingly, an explanation on them will be avoided for the brevity of the description.

The resonance body 410 has given internal spaces 412*a* and 412*b* formed at the inside thereof, while having an outwardly convex outer surface. That is, the diameter of the resonance body 410 at the center thereof is larger than that at both ends thereof. The position adjuster 450 is inserted into the internal spaces 412*a* and 412*b*.

In this case, the resonance body 410 has the outwardly convex outer surface, so that the area contacted with the sound resonating through the strings is expanded to allow the resonance of the sound to be increased, which makes the tone (sound field) of the sound hole more abundant.

Besides, the resonance body 410 distributes the pressures applied from the top plate 12 and the bottom plate 13 of the guitar to the outwardly convex outer surface thereof, thus more rigidly supporting the top plate 12 and the bottom plate 13 of the guitar.

The resonance body 410 includes a first resonance body 410*a* on which a portion of a first resonance transmitter 430*a* of the resonance transmitter 430 operates and a second resonance body 410*b* on which a portion of a second resonance transmitter 430*b* of the resonance transmitter 430 operates.

Accordingly, one end of the first resonance body 410*a* is open to allow the first resonance transmitter 430*a* to move from one end of the first resonance body 410*a* in the longitudinal direction of the resonance body 410, and the other end of the first resonance body 410*a* is fastened to one of the second resonance body 410*b*. The other end of the second resonance body 410*b* is open to allow the second resonance transmitter 430*b* to move from the other end of the second resonance body 410*b* in the longitudinal direction of the resonance body 410.

At this time, the diameter of one end of the first resonance body 410*a* is the same as that of the other end of the second resonance body 410*b*.

In this case, the other end of the first resonance body 410*a* has a shape of a protruding screw fastened to one end of the second resonance body 410*b*, and one end of the second resonance body 410*b* has a shape of a concave screw fastened to the other end of the first resonance body 410*a*. Of course, one end of the second resonance body 410*b* may protrude, and the other end of the first resonance body 410*a* may be concave.

That is, only if the other end of the first resonance body 410*a* and one end of the second resonance body 410*b* are fastened to each other to insert the position adjuster 450 thereinto and to move the resonance transmitter 430, their shapes do not matter.

Also, the first resonance transmitter 430*a* and the second resonance transmitter 430*b* have a conical shape.

In this case, the diameter of one end of the first resonance body 410*a* is smaller than that of the other end of the first resonance transmitter 430*a*. That is, one end of the first resonance transmitter 430*a* passes through one end of the first resonance body 410*a*, but the other end of the first resonance transmitter 430*a* does not pass through one end of the first resonance body 410*a*, while being disposed in the internal spaces 413*a* and 413*b* of the first resonance body 410*a*.

At this time, a portion 411*a* on one end of the first resonance body 410*a* is separated to allow the first resonance transmitter 430*a* to be easily inserted thereinto. That is, after the portion 411*a* on one end of the first resonance body 410*a* is separated, the first resonance transmitter 430*a* is inserted into one end of the first resonance body 410*a*, and next, the portion 411*a* is fastened to one end of the first resonance body 410*a*, so that the first resonance transmitter 430*a* can be easily inserted into one end of the first resonance body 410*a*. Of course, only if the first resonance transmitter 430*a* is easily inserted into one end of the first resonance body 410*a*, the first resonance body 410*a* may have any shape.

Under the above-mentioned configuration, the first resonance transmitter 430*a* is not arbitrarily deviated from the first resonance body 410*a* even if the deviation prevention portion and the deviation prevention step as mentioned in the second and third examples of the present invention are not formed.

The relation between the second resonance transmitter 430*b* and the second resonance body 410*b* can be fully understood from that between the first resonance transmitter 430*a* and the first resonance body 410*a*, which will be not explained anymore.

The first resonance body 410*a* and the second resonance body 410*b* as mentioned above are made of various materials such as all kinds of timbers, plastic, bone materials, tusk, iron and the like. According to the present invention, the first resonance body 410*a* and the second resonance body 410*b* are desirably made of a urethane or acetal.

The tone control member 400 according to the fourth example of the present invention is symmetrically formed in left and right sides, while having the outwardly convex intermediate region, thus allowing the resonance of sound from the top plate 12 and the bottom plate 13 of the guitar to be balancedly transmitted and more effectively maintaining the balance between high frets and low frets.

As shown in FIGS. 13 and 14, a tone control member 500 according to a fifth example of the present invention includes a resonance body 510, a resonance transmitter 530, and a position adjuster 550.

The functions of the parts of the tone control member 500 and the organic relations between the functions are the same as those in the tone control members 200, 300 and 400 according to the second, third and fourth examples of the present invention, and accordingly, an explanation on them will be avoided for the brevity of the description.

The resonance body 510 has given internal spaces 513*a* and 513*b* formed at the inside thereof, while having an outwardly convex outer surface thereof.

That is, the diameter of the resonance body 510 at the center thereof is larger than that at both ends thereof. The position adjuster 550 is inserted into the internal spaces 513*a* and 513*b*.

Further, one end of the resonance body 510 is open, and a resonance cap 520 is located on one end open of the resonance body 510 to move the resonance transmitter 530 in the longitudinal direction of the resonance body 510.

One end of the resonance cap 520 is open to move the resonance transmitter 530 in the longitudinal direction of the resonance body 510 and the other end of the resonance cap 520 is fastened to one end of the resonance body 510.

At this time, the diameter of one end of the resonance cap 520 is smaller than that of the other end of the resonance transmitter 530. That is, one end of the resonance transmitter 530 passes through one end of the resonance cap 520, but the other end of the resonance transmitter 530 does not pass through one end of the resonance cap 520, while being disposed in the internal spaces 513*a* and 513*b* of the resonance body 510.

Further, a portion 521 on one end of the resonance cap 520 is separated to allow the resonance transmitter 530 to be easily inserted thereinto. That is, after the portion 521 on one end of the resonance cap 520 is separated, the resonance transmitter 530 is inserted into the resonance cap 520, and next, the portion 521 is fastened to the resonance cap 520, so that the resonance transmitter 530 can be easily inserted into one end of the resonance cap 520. Of course, only if the resonance transmitter 530 is easily inserted into one end of the resonance cap 520, the resonance cap 520 may have any shape.

Under the above-mentioned configuration, the resonance transmitter 530 is not arbitrarily deviated from the resonance cap 520 even if the deviation prevention portion and the deviation prevention step as mentioned in the second and third examples of the present invention are not formed.

In this case, the other end of the resonance cap 520 has a shape of a protruding screw fastened to one end of the resonance body 510, and one end of the resonance body 510 has a shape of a concave screw fastened to the other end of the resonance cap 520.

Of course, one end of the resonance body 510 may protrude, and the other end of the resonance cap 520 may be concave.

The other end of the resonance body 510 has a shape of a cone. If the other end of the resonance body 510 has a shape of a cone, it has a tip. The tip of the resonance body 510 is desirably sharp, dull rounded, or a circularly angled to ensure maximum resonance, thus transmitting balanced sound to the space between the top plate 12 and the bottom plate 13 of the guitar.

At this time, the shape of the tip of the resonance body 510 may be varied in accordance with the characteristics of sound.

As shown in FIGS. 15 and 16, a tone control member 600 according to a sixth example of the present invention includes a resonance body 610, a resonance transmitter 630, and a position adjuster 650.

The functions of the parts of the tone control member 600 and the organic relations between the functions are the same as those in the tone control members 200, 300, 400 and 500 according to the second, third, fourth and fifth examples of the present invention, and accordingly, an explanation on them will be avoided for the brevity of the description.

The resonance body 610 has a first resonance body 610*a* and a second resonance body 610*b* having given internal spaces formed at the inside thereof.

The other end of the first resonance body 610*a* has a shape of a concave screw fastened to one end of the second resonance body 610*b*, and one end of the second resonance body 610*b* has a shape of a protruding screw fastened to the other end of the first resonance body 610*a*. Of course, the other end of the first resonance body 610*a* may protrude, and the other end of the second resonance body 610*b* may be concave.

That is, only if the other end of the first resonance body 610*a* and one end of the second resonance body 610*b* are fastened to each other to insert the position adjuster 650 thereinto and to move first and second resonance transmission fixing parts 611*a* and 611*b* as will be discussed later, their shape do not matter. The position adjuster 650 will be understood from the above-mentioned examples of the present invention, which will be not explained anymore for the brevity of the description.

One end of the first resonance body 610*a* is open, and the first resonance transmission fixing part 611*a* is inserted into one end of the first resonance body 610*a* in such a manner as to be operated in the longitudinal direction of the first resonance body 610*a*, while the other end of the first resonance body 610*a* being fastened to one end of the second resonance body 610*b*. The other end of the second resonance body 610*b* is open, and the second resonance transmission fixing part 611*b* is inserted into the other end of the second resonance body 610*b* in such a manner as to be operated in the longitudinal direction of the second resonance body 610*b*.

At this time, the diameter of one end of the first resonance body 610*a* is the same as that of the other end of the second resonance body 610*b*.

As shown in FIG. 16, the first resonance transmission fixing part 611*a* has a fastening member 612*a* protruding from the upper portion of one end thereof in such a manner as to be screw-coupled to a first resonance transmitter 630*a* of the resonance transmitter 630, and the second resonance transmission fixing part 611*b* has a fastening member 612*b* protruding from the upper portion of the other end thereof in such a manner as to be screw-coupled to a second resonance transmitter 630*b* of the resonance transmitter 630. In this case, the fastening member 612*a* of the first resonance transmission fixing part 611*a* and the fastening member 612*b* of the second resonance transmission fixing part 611*b* have the shape of screw, but they may have any shape only if they are fixedly fastened to the first resonance transmitter 630*a* and the second resonance transmitter 630*b*.

Further, the first resonance transmission fixing part 611*a* is inserted into the first resonance body 610*a* in such a manner as to be operated to left and right sides, and the second resonance transmission fixing part 611*b* is inserted into the second resonance body 610*b* in such a manner as to be operated to left and right sides.

An explanation on the first resonance transmitter 630*a* and the second resonance transmitter 630*b* will be fully understood from the above-mentioned examples of the present invention, and accordingly, their detailed description is avoided.

The first resonance body 610*a*, the second resonance body 610*b*, the first resonance transmitter 630*a*, and the second resonance transmitter 630*b* as mentioned above are made of various materials such as all kinds of timbers, plastic, bone materials, tusk, iron and the like. According to the present invention, they are desirably made of a urethane or acetal.

The tone control member 600 according to the sixth example of the present invention is symmetrically formed in left and right sides, thus allowing the resonance of sound from the top plate 12 and the bottom plate 13 of the guitar to be balancedly transmitted and more effectively maintaining the balance between high frets and low frets.

As mentioned above, the tone control member according the preferred embodiments of the present invention serves to connect the top plate 12 and the bottom plate 13 of the guitar and to allow the sound between high frets and low frets to be balanced well.

Further, if the tone control member is expandably adjusted, tension is extended to produce relatively hard sound, so that it can be easily controlled in accordance with a player's individual preference.

Furthermore, the tone control member of the present invention can prevent the body of the guitar from being deformed to avoid the changes in sound and at the same time can finely adjust the tone, while being provided as an attachment like an accessory.

While the present invention has been described with reference to the particular illustrative embodiments, it is not to be restricted by the embodiments but only by the appended claims. It is to be appreciated that those skilled in the art can change or modify the embodiments without departing from the scope and spirit of the present invention.

INDUSTRIAL APPLICABILITY

The invention can be used in fields where acoustic guitar is applied.

SEQUENCE LISTING FREE TEXT

100: contacting and moving member
110: coupling holes
120: nuts
130: moving screw
140: adjusting knob
151: driving gear
152: rotary shaft
153: driving motor
154: operating switch
210, 310, 410, 510: resonance body
310*a*: first resonance body
310*b*: second resonance body
211, 311: deviation prevention portion

311*a*: first deviation prevention portion
311*b*: second deviation prevention portion
230, 330, 430, 530: resonance transmitter
330*a*: first resonance transmitter
330*b*: second resonance transmitter
250, 350, 450, 550: position adjuster
513*a*, 513*b*: internal spaces
520: resonance cap

The invention claimed is:

1. A functional acoustic guitar comprising:
a body having a top plate, a bottom plate and a side plate connecting the top plate and the bottom plate with each other;
a neck fixed to one side of the body;
a head disposed at an end portion of the neck; and
a tone control member mounted at an inside of the body in such a manner as to be controlled in length to support a space between the top plate and the bottom plate of the body,
wherein the tone control member comprises:
a contacting and moving member; and
a height control means expandably and contractably moving the contacting and moving member,
wherein the contacting and moving member is formed of a contact member segmented into two parts and has a sectional shape of a cone, a conical frustum, or a cylinder, and
wherein the height control means has a screw moving way so that the contact member segmented symmetrically into two parts is expanded and contracted.

2. A functional acoustic guitar comprising:
a body having a top plate, a bottom plate and a side plate connecting the top plate and the bottom plate with each other;
a neck fixed to one side of the body;
a head disposed at an end portion of the neck; and
a tone control member mounted at an inside of the body in such a manner as to be controlled in length to support a space between the top plate and the bottom plate of the body,
wherein the tone control member comprises:
a contacting and moving member; and
a height control means expandably and contractably moving the contacting and moving member,
wherein the contacting and moving member is formed of a contact member segmented into two parts and has a sectional shape of a cone, a conical frustum, or a cylinder, and
wherein the height control means comprises:
coupling holes formed on the end portions of the two segmented parts of the contact member facing each other;
nuts mounted in the coupling holes;
a moving screw screw-coupled to the nuts; and
an adjusting knob fixed to the moving screw.

3. A functional acoustic guitar comprising:
a body having a top plate, a bottom plate and a side plate connecting the top plate and the bottom plate with each other;
a neck fixed to one side of the body;
a head disposed at an end portion of the neck; and
a tone control member mounted at an inside of the body in such a manner as to be controlled in length to support a space between the top plate and the bottom plate of the body,
wherein the tone control member comprises:
a resonance body having a given internal space formed therein;
a resonance transmitter whose a portion is inserted into the resonance body; and
a position adjuster inserted into the resonance body to move the resonance transmitter in a longitudinal direction of the resonance body.

4. The functional acoustic guitar according to claim 3, wherein one end of the resonance body is formed to allow the resonance transmitter to move in the longitudinal direction of the resonance body by means of the position adjuster disposed in the internal space of the resonance body, and the other end of the resonance body is fixedly formed or is formed to allow the resonance transmitter to move in the longitudinal direction of the resonance body by means of the position adjuster.

5. The functional acoustic guitar according to claim 4, wherein the other end of the resonance body is fixedly fastened to a resonance support supporting the position adjuster to transmit balanced sound to the top plate and the bottom plate of the guitar.

6. The functional acoustic guitar according to claim 3, wherein the position adjuster moves the resonance transmitter in a longitudinal direction by using elasticity thereof.

7. The functional acoustic guitar according to claim 3, wherein the resonance body or the resonance transmitter is made of any one selected from timbers, plastic, bone materials, tusk, iron, a urethane and an acetal to balancedly distribute the sound resonated through strings to the top plate and the bottom plate of the guitar.

8. The functional acoustic guitar according to claim 5, wherein the resonance transmitter or the resonance support is formed of a conical shape, and the tip of the cone is rounded.

9. A tone control member comprising:
a contacting and moving member contacting with a top plate and a bottom plate of a guitar; and
a height control means expandably and contractably moving the contacting and moving member,
wherein the height control means has a screw moving way so that a contact member segmented symmetrically into two parts is expanded and contracted.

10. A tone control member comprising:
a contacting and moving member contacting with a top plate and a bottom plate of a guitar; and
a height control means expandably and contractably moving the contacting and moving member,
wherein the height control means comprises:
coupling holes formed on end portions of two segmented parts of a contact member facing each other;
nuts mounted in the coupling holes;
a moving screw screw-coupled to the nuts; and
an adjusting knob fixed to the moving screw.

11. A tone control member comprising:
a resonance body having a given internal space formed therein;
a resonance transmitter whose a portion is inserted into the resonance body and contacting with the top plate or the bottom plate of the guitar; and
a position adjuster inserted into the resonance body to move the resonance transmitter in a longitudinal direction of the resonance body.

12. The tone control member according to claim 11, wherein one end of the resonance body is formed to allow the resonance transmitter to move in the longitudinal direction of the resonance body by means of the position adjuster disposed in the internal space of the resonance body, and the other end of the resonance body is fixedly formed or is formed to allow the resonance transmitter to move in the longitudinal direction of the resonance body by means of the position adjuster.

13. The tone control member according to claim 12, wherein the other end of the resonance body is fixedly fastened to a resonance support supporting the position adjuster to transmit balanced sound to the top plate and the bottom plate of the guitar.

14. The tone control member according to claim 1, wherein the position adjuster moves the resonance transmitter in a longitudinal direction by using elasticity thereof.

15. The functional acoustic guitar according to claim 1, wherein the contacting and moving member has the sectional shape of the cone having a tip rounded.

16. The functional acoustic guitar according to claim 2, wherein the contacting and moving member has the sectional shape of the cone having a tip rounded.

* * * * *